United States Patent [19]

Thomas

[11] 3,978,805

[45] Sept. 7, 1976

[54] STABILIZED FLOATING PLATFORMS

[75] Inventor: David G. Thomas, Oak Ridge, Tenn.

[73] Assignee: The Unites States of America as represented by the United States Energy Research and Development Administration, Washington, D.C.

[22] Filed: Apr. 25, 1975

[21] Appl. No.: 571,444

[52] U.S. Cl. ..... 114/.5 F; 9/8 P; 114/123

[51] Int. Cl.[2] ..... B63B 35/44

[58] Field of Search ..... 9/8 P; 114/.5 R, .5 D, 114/123, .5 F, 43.5 R

[56] References Cited

UNITED STATES PATENTS 3,380,091 4/1968 Saurin et al. ..... 9/8 P 3,450,084 6/1969 Gerbracht ..... 114/123

*Primary Examiner*—Trygve M. Blix
*Assistant Examiner*—Gregory W. O'Connor
*Attorney, Agent, or Firm*—Dean E. Carlson; David S. Zachry; Earl L. Larcher

[57] ABSTRACT

The subject invention is directed to a floating platform for supporting nuclear reactors and the like at selected offshore sites. The platform is provided with a stabilizer mechanism which significantly reduces the effects of wave action upon the platform and which comprises a pair of relatively small floats attached by rigid booms to the platform at locations spaced therefrom for reducing wave pitch, acceleration, and the resonance period of the wave.

2 Claims, 12 Drawing Figures

STABILIZED FLOATING PLATFORMS

The present invention is directed generally to floating platforms for supporting various systems at off-shore sites, and more particularly to a stabilized floating platform wherein the various effects of wave motion upon the platform are substantially reduced. This invention was made in the course of, or under, a contract with the United States Energy Research and Development Administration.

Off-shore facilities are being utilized in many technological areas with perhaps the most common being associated with the petroleum industry. Such facilities use various types of platforms or supporting structures for maintaining the facilities above the surface of the water and include such systems as platforms secured to the ocean floor by rigid stilts or floating-type platforms including self-propelled and towed structures which require intricate anchoring systems for maintaining the platform in the appropriate position. Efforts to minimize the effects of wave action on such off-shore facilities include the use of breakwaters in relatively shallow areas as the continental shelf off the eastern coast of the United States. However, in deeper waters, such as the Pacific Ocean, such breakwaters cannot be satisfactorily employed.

Accordingly, it is the primary objective or aim of the present invention to provide a stabilized floating platform or structure for off-shore use wherein relatively heavy structures, such as nuclear reactors and the like, may be suitably supported. The platform for supporting a load upon a body of water is buoyant and has in combination therewith stabilizing means for substantially reducing the effect of wave action upon the platform. The platform for carrying the load has a length-to-width ratio in the range between 1 to 2, and the stabilizing means comprise discrete float means disposed adjacent to and separated from one another by the platform. Elongated means or booms projecting between each of the float means and the platforms rigidly secure the float means to the platform. The elongated means have an effective length less than about one-third of the length of the platform.

Figure 10:
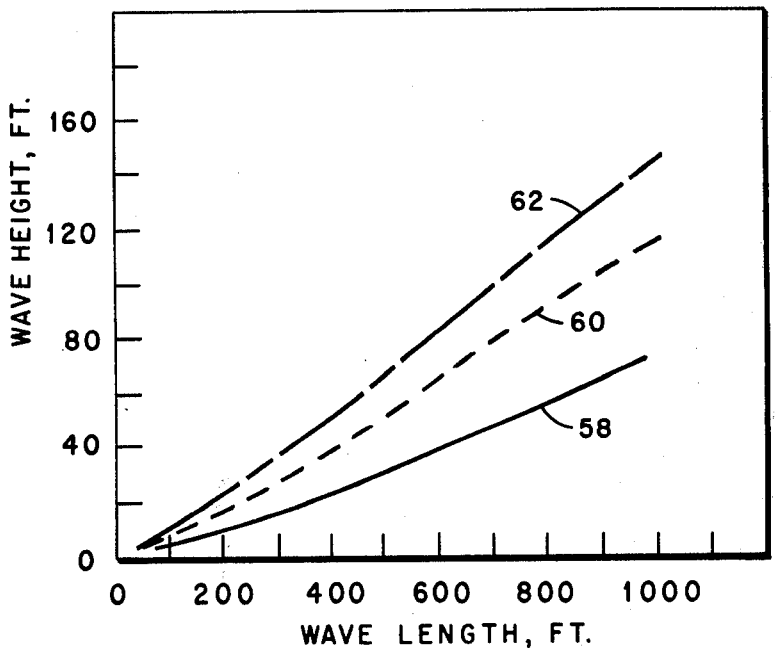
Figure 9A:
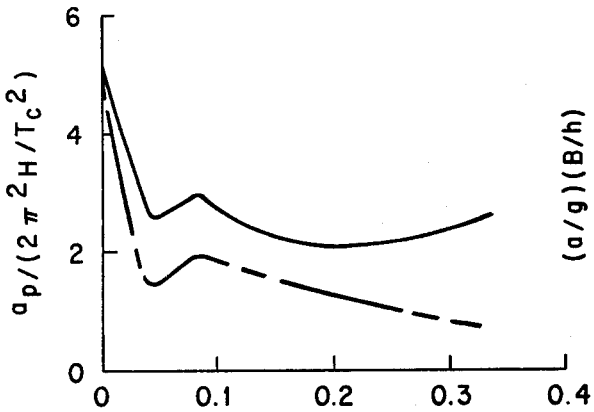
Figure 9B:
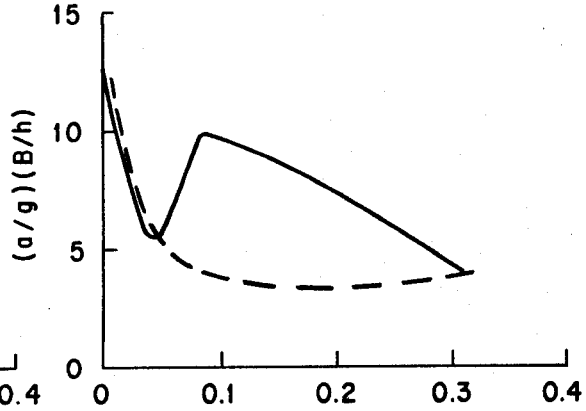
Figure 9C:
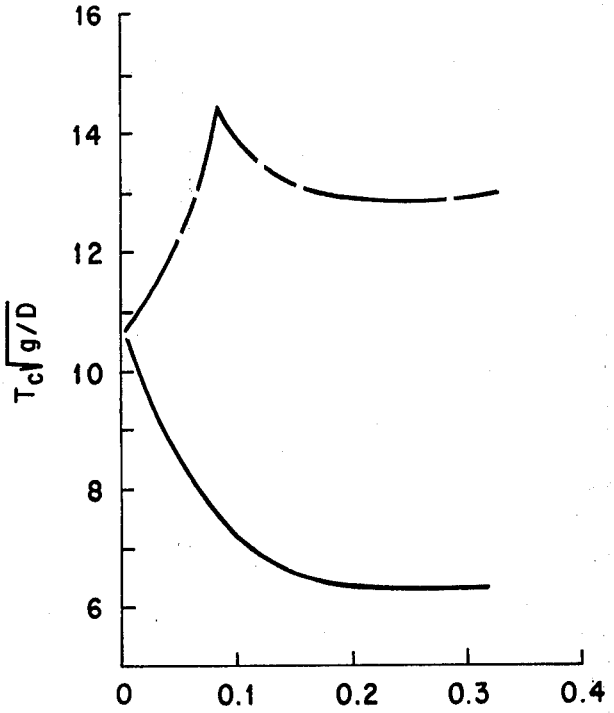

FIGS. 9A, 9B, and 9C are graphs showing the effects of the ratio of length of the float to the length of the platform on the wave period and acceleration of a platform having a length-to-breadth ratio of 2; and FIG. 10 is a graph showing the wave length and height for a fully arisen sea over a period of time with the curves illustrating the average, the third highest average, and the tenth highest average of wave length and height over this period of time.

Described generally, the present invention comprises a floating platform for supporting off-shore facilities, such as nuclear reactors, ports, complexes relating to the petroleum industry, etc. The platform is stabilized by employing a stabilizing system capable of significantly reducing the effect of the wave action upon the load supporting platform. Generally, this stabilization is achieved by positioning floats at opposite sides of the platform and maintaining the floats in a spaced relationship with the platform by employing rigid coupling booms. The utilization of the float system spaced from the platform considerably reduces the wave action upon the platform. For example, the platform acceleration may be reduced to 60 percent or less of that which a platform without the stabilizers would be subjected to. The maximum platform pitch may be reduced to one-fifth or less than that of a simple, i.e., non-stabilized, platform. Further, the resonance period of the platform, that is the period for which there is maximum interaction of the platform with waves of that same period, may be reduced to less than 75 percent of the resonance period of a simple platform.

It has been found by previous studies that floating platforms suitable for supporting nuclear reactors and the like are preferably of rectangular configurations where the longer dimension is generally no greater than twice the shorter dimension. Accordingly, it was decided for the purpose of the present invention that any study of a stabilizer for such a platform should be conducted with a platform having a length-to-breadth ratio in the range of 1 to 2:1.

Figure 1:
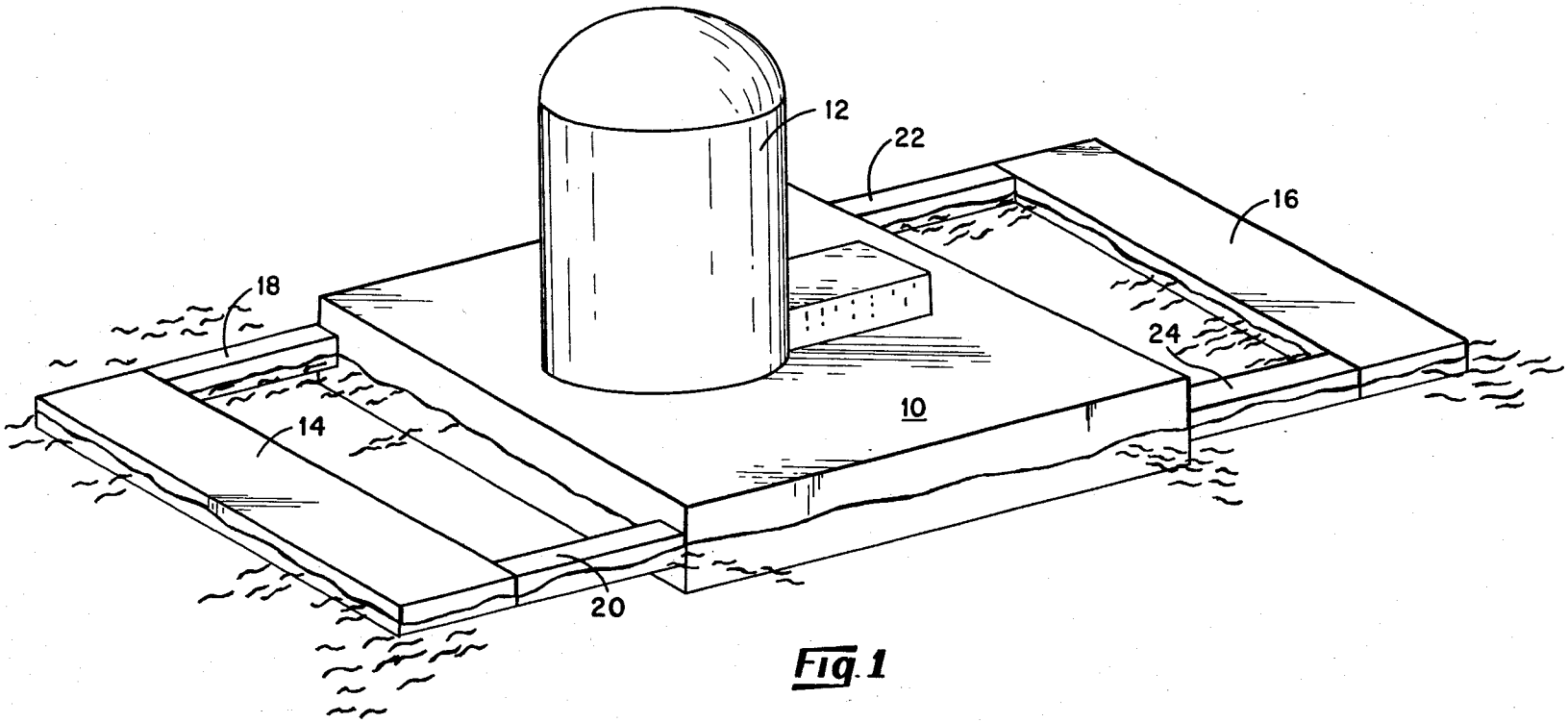
FIG. 1 is a somewhat schematic perspective view showing the stabilized platform of the present invention with a nuclear reactor disposed thereon.
Figure 2:
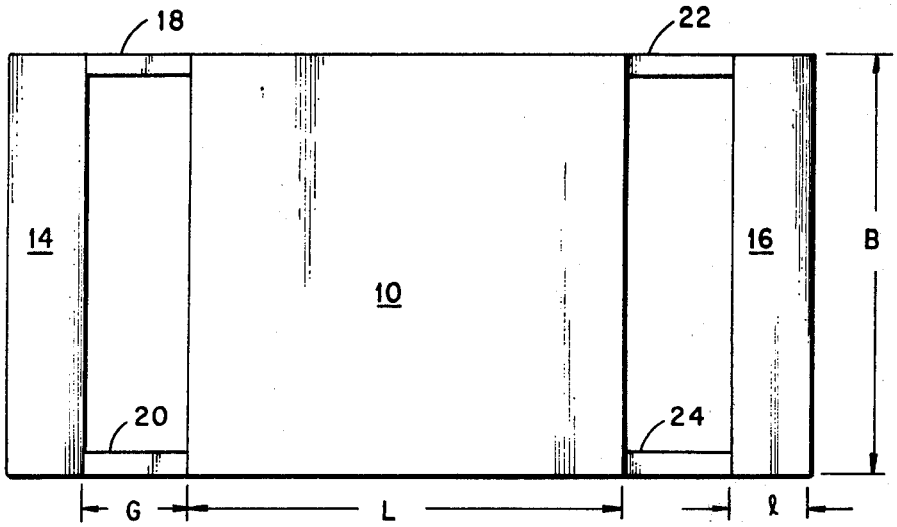
FIG. 2 is a top plan view of the stabilized platform showing details of the platform and the platform-stabilizing floats.
Figure 3:
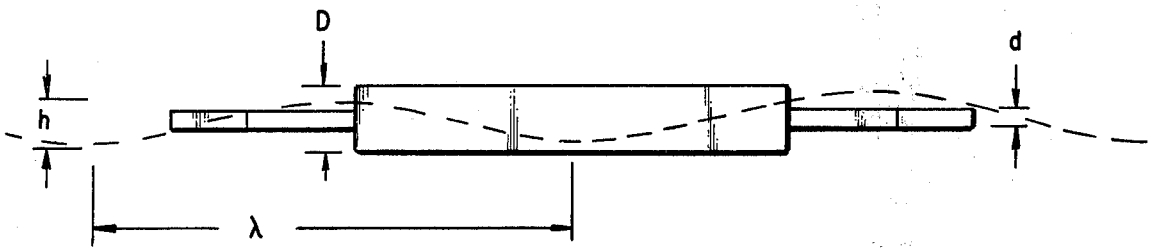
FIG. 3 is an elevational view of the FIG. 2 arrangement showing further details of the platform and float construction.

As shown in FIGS. 1–3, the stabilized floating platform of the present invention comprises a buoyant platform 10 of a rectangular configuration and of dimensions suitable for supporting the system envisioned. For example, in FIG. 1, a nuclear reactor building, such as generally shown at 12, may be supported on platform 10 having a length (L) of about 400 to 800 feet and a breadth (B) of about 400 to 800 feet. The buoyant platform 10 may be of any suitable construction which will provide the necessary floatation for supporting the system to be placed thereon. For example, a steel structure with a series of water-tight compartments similar to those employed in marine vessels would provide suitable buoyancy.

The stabilizer floats 14 and 16 for the platform are secured to the platform 10 at opposite ends thereof by rigid parallel elongated means or booms 18 and 20 and 22 and 24, respectively. As shown, the floats 14 and 16 are of rectangular configuration and disposed parallel to each other and to the ends of the platform 10 by the booms which are, in turn, parallel to one another as shown. In FIGS. 2 and 3, the length, breadth, and thickness of the platform are indicated by the letters L, B, and D, respectively. The dimensions of the floats 14 and 16 are indicated by letters $l$, $B$, and $d$ for the length, breadth, and thickness, respectively. As shown, the breadth of the platform and the breadth of the floats are similar. Further, with this arrangement, each of the booms is disposed parallel to a side of the platform and forms a projection therewith. The spacing between the platform 10 and the floats 14 and 16 as defined by the length of the boom is indicated by the letter G. FIG. 3 also carries letters representative of the wave height ($h$) and wave length ($\lambda$).

It was found that satisfactory stabilization of the platform of the present invention may be achieved with the platform 10 having a length-to-breadth ratio in the range of 1 to 2:1 when the floats 14 and 16 were spaced from the platform a distance (G) in the range corresponding to about one-eighth to about one-half the length of the platform. Also, the length of the float found to be satisfactory is in the range of less than about 0.31 of the length L of the platform down to an effective length near 0.04 of the length of the platform. Further, the thickness $d$ of the float and the length L of the platform is at a ratio of $d$/L in the range of 0.007 to about 0.07. This thickness range of the float is believed to be satisfactory for effecting the necessary stabilization.

In order to determine what range of dimensions for the platform and float would be effective, scale models of the platforms were constructed for testing in a wave tank 4 feet long by 7 feet wide with a water depth of 21 inches. This scale provided a scaling factor of 1 to 200. Waves were generated by repeatedly inserting a wedge at one end of the tank with a suitable baffle at the other end to reduce wave reflections. The change in wave height was provided by varying the length of the stroke of the wave-forming wedge.

Results of the investigation employing the scale model facility described above are shown in FIGS. 4–9 with the stabilized platform of various dimensions compared to the non-stabilized platforms, that is, platforms without the attached floats 14 and 16 and in the aforementioned length-to-breadth ratio in the range of 1 to 2:1. In these FIGS., the curves are illustrative of various wave action effects, such as acceleration, pitch, and wave period. In the equations utilized for generating these curves, dimensionless quantities are utilized where ($g$) is the value of gravity, ($a$) is the acceleration, ($h$) is the wave height, and (T) is the period of wave motion. The other letters used in the equations, except for FIG. 9A as will be explained below, are dimensions of the stabilized floats and platforms as noted above.

Figure 4:
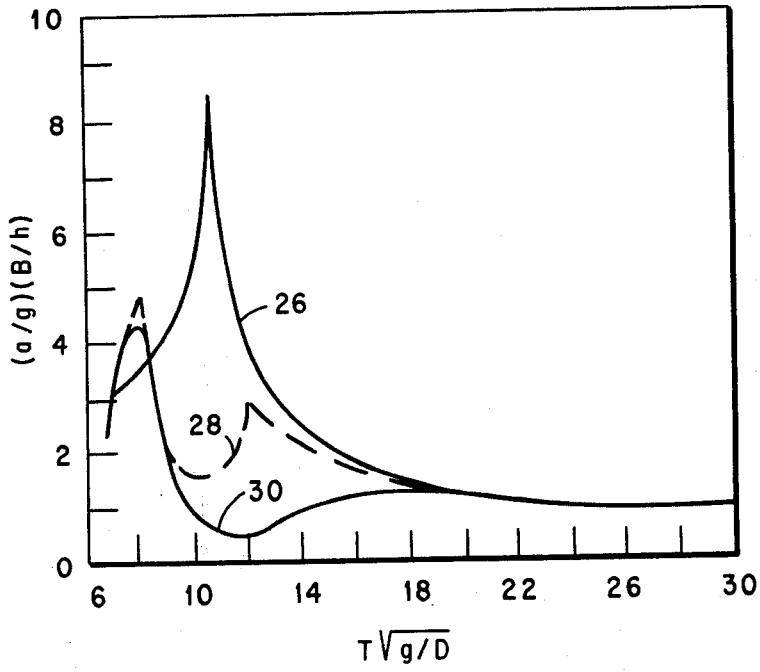
FIG. 4 is a graph illustrating the effect of the stabilizers on the platform acceleration with the mass of the platform being uniformly distributed over the platform.

FIG. 4 shows acceleration values measured at the forward end of several floating platforms as a function of wave period. The platforms employed in FIG. 4 had a length-to-breadth ratio of 2:1 and uniform distribution of mass. In this FIG., line 26 is directed to a platform without the stabilizing floats, line 28 is representative of a platform with only one stabilizing float, and line 30 is representative of a platform with both stabilizing floats 14 and 16 attached thereto. The stabilizers 14 and 16 reduce the acceleration factor by one-half and decrease the resonance period to about 75 percent of that of the non-stabilized platform values.

Figure 5:
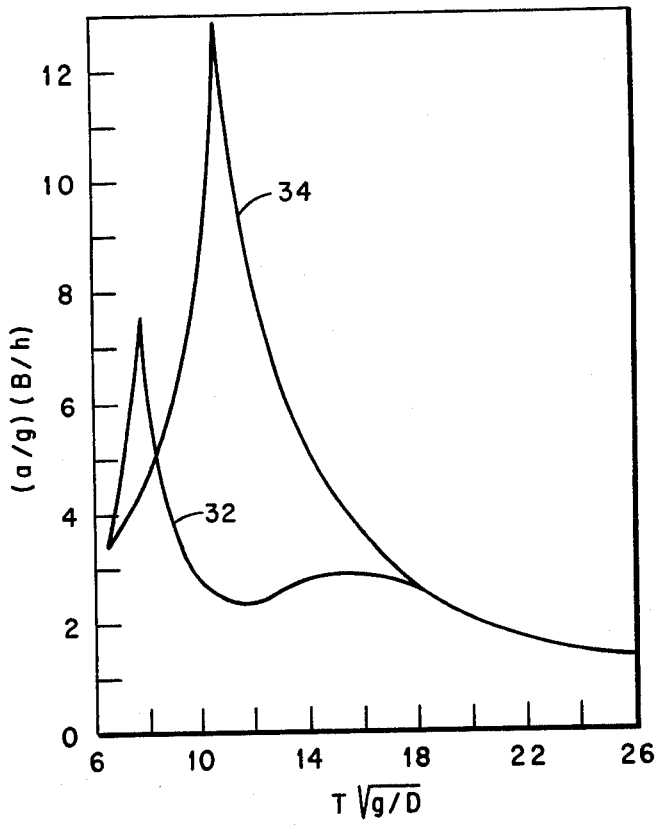
FIG. 5 is a graph showing the effect of the stabilizers on platform acceleration with the mass of the platform concentrated at the center thereof.

FIG. 5 shows curves for platforms with a length-to-breadth ratio of 1:1, but with 33 percent of the total platform weight concentrated at the center thereof to simulate a nuclear reactor and pressure vessel emplacement. Curve 32 shows a stabilized platform which reduces the acceleration to 57 percent of that of the non-stabilized platform as shown by curve 34 with the resonance period being reduced to 70 percent of the non-stabilized platform value. The results shown in this FIG. were found to be true for scale wave height in the range of 2 to 30 feet.

Figure 6:
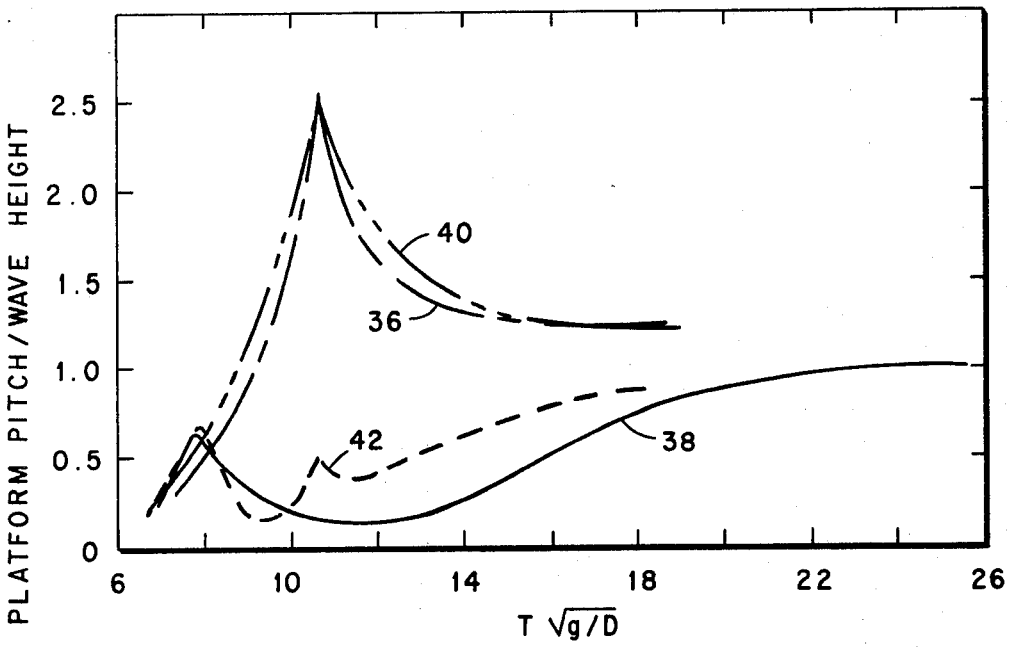
FIG. 6 is a graph showing the effects of the stabilizers on the ratio of platform pitch to wave height.

FIG. 6 shows the ratio of platform pitch amplitude to wave height as a function of wave period. In this FIG., the spacing or gap (G) between the floats and the platform is one-fourth the length of the platform with curves 36 and 38 relating to a non-stabilized platform and a stabilized platform, respectively, having a length-to-breadth ratio of 2:1. Curves 40 and 42, respectively, relate to a non-stabilized platform and a stabilized platform having a length-to-breadth ratio of 1:1. For long wave periods the motion was largely due to wave heave and the ratio of platform pitch-to-wave height was about 1. At the resonance condition for the nonstabilized platform the platform pitch was about 2.5 times the wave height. However, even at the resonance condition, the pitch of the stabilized platform was only 0.5 to 0.7 of the wave height.

Figure 7:
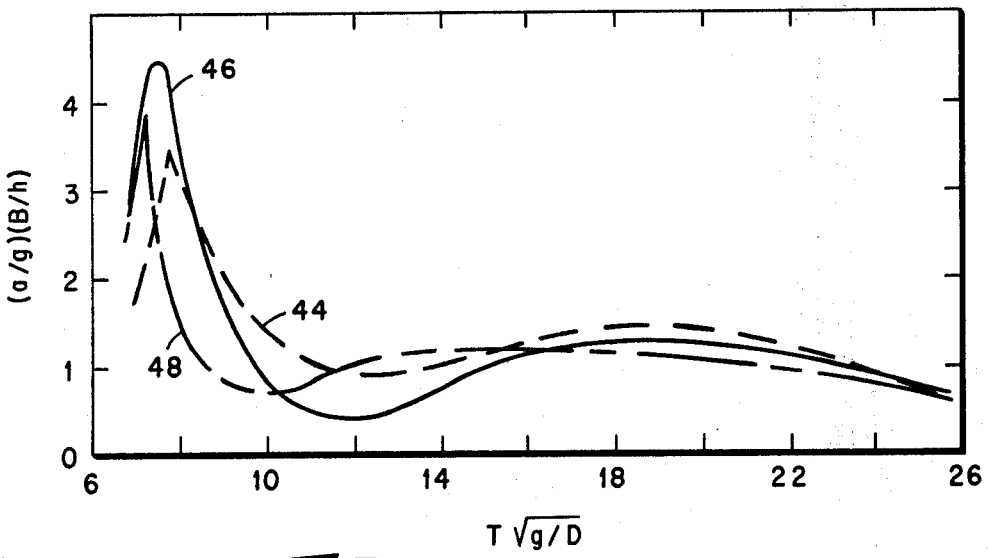
FIG. 7 is a graph showing the effect of the change in the spacing or gap between the stabilizers and the platform on acceleration.

In FIG. 7 acceleration values are shown as a function of the wave period for three different gap distances between the stabilized floats and platform. Curves 44, 46 and 48 are representative of gap (G) corresponding to one-half, one-fourth, and one-eighth of the platform length. Also, the lengths of the floats in this FIG. were 0.15 of the platform length. The thickness of the stabilizer had little or no effect on the results, at least in the range of 0.007 to about 0.07 of the length of the platform. It appeared that the maximum acceleration occurred at a gap-to-length ratio of about one-fourth with smaller values occurring at one-eighth and one-half.

Although the particular mechanism responsible for the effect of the pitch stabilizers of the present invention is not clearly understood, it is believed that the passivating effect of the stabilizers is not simply provided by increasing the length and breadth ratio of the platform. This belief is substantiated in FIG. 8 which shows curves obtained with a non-stabilized platform having a length-to-breadth ratio of 3:1 and a platform which has an effective length of 3:1, i.e., the length of the stabilizers plus the gaps were included in the overall platform length. In this FIG., curves 50 and 52 are directed to the non-stabilized platforms whereas curves 54 and 56 are directed to stabilized platforms. It is obvious from these curves that the stabilizing floats considerably reduce the acceleration and the pitch-to-height wave ratio as well as the resonance period.

Figure 8:
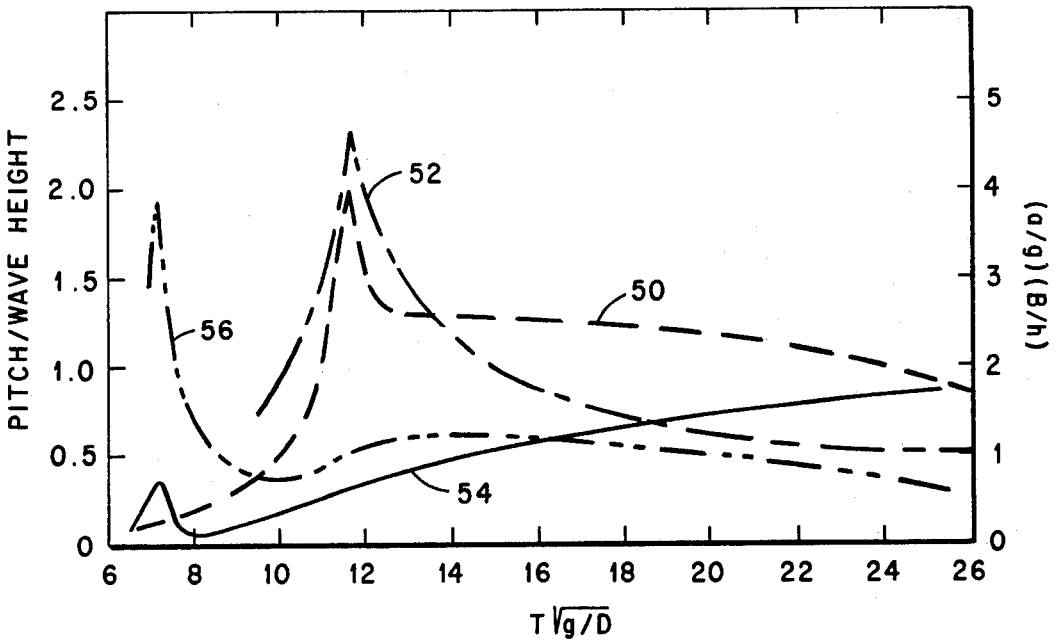
FIG. 8 is a graph comparing the results between a platform having a length-to-breadth ratio of 3 with a stabilized platform having a length-to-breadth ratio of 2 of the same overall length.

Tests conducted by employing pitch stabilizers or floats having a ratio of float length-to-platform length in the range of 0.04 to 0.31 and a ratio of stabilizer float thickness to platform length ($d$/L) of about 0.007 were utilized for generating the curves shown in FIGS. 9A, 9B, and 9C. In these tests, the outer edge of the stabilizer was maintained at a fixed position corresponding to 0.375 length fore-and-aft. While the stabilizer length was varied from test to test, it was found that the gap between the platform and the float changed the results but not the overall length plus stabilizer. As shown in FIG. 8 above, the results obtained with the float stabilizers showed a sharp maximum acceleration being shifted to a smaller period than the natural platform period. This sharp increase is designated as the primary peak. Following the primary peak there is a much more rounded maximum shifted to a period larger than the natural platform period and is designated as a secondary peak. The results of the maximum acceleration represented by the primary peak and secondary peak are shown in FIGS. 9A, 9B, and 9C with the solid line in these FIGS. being representative of the primary peak, and the broken line being representative of the secondary peak. In FIG. 9 (A–C) both the primary and secondary peaks are shown as a function of the ratio $l/L$; and examination of these curves indicates that a $l/L$ value of 0.16 is near optimum for obtaining the effect of the stabilizer. In FIG. 9A, the term $a_p/(2\pi^2 H/T_c^2)$ represents the acceleration of the platform non-dimensionalized by dividing by the acceleration of a wave of height H and whose period was the same as the resonant period of the platform.

It is to be understood that the construction described herein will only stabilize a platform when the wave motion comes from a direction wherein it would initially contact one of the stabilizer floats. In order for this condition to always exist an anchoring system would be utilized where the platform would be turned to present one of the stabilizer floats to the wave front. This is a conventional, well-known method of anchoring floating units.

FIG. 10 shows typical values for height, period, and wave length for fully arisen seas are found in known literature. In this FIG., line 58 is the average wave height with line 60 being representative of the one-third highest waves occurring over this period while line 62 is representative of the highest 10 percent waves occurring over this period.

As pointed out above, the stabilized platform of the present invention reduces the acceleration to 60 percent or less of that obtainable by employing a simple platform. The maximum pitch of such a stabilized platform is reduced to one-fourth to about one-fifth of that of the non-stabilized platform. Also, the resonance period is reduced to less than 75 percent of the resonance period for the non-stabilized platform. The reduction of the resonance period has important consequences with respect to the reduction and acceleration and pitch in that for a typical resonance period for a floating platform in the order of about 10 seconds, the addition of the stabilizing floats would reduce the resonance period to about 7.5 seconds. This shorter period, in turn, causes a reduction in the wave height to which the stabilized platform is most sensitive to about only 31 percent of the wave height to which a non-stabilized platform under resonance condition is most sensitive. Thus, since both the acceleration and pitch are scaled by wave height, the total reduction in acceleration achieved by using the stabilizing floats of the present invention is to about 0.19 of the value of the non-stabilized platform, while the reduction in platform pitch is to about 0.08 of the value for the nonstabilized platform.

It will be seen that the stabilized platform of the present invention provides a significant contribution to the employment of facilities at off-shore locations especially where the facilities may be disposed over water of such depth where conventional floating structures have previously been unsuccessful with respect to stability.

What is claimed is:

1. A buoyant structure for supporting a load upon a body of water and having in combination therewith stabilizing means for substantially reducing the effect of wave action upon the structure, comprising a buoyant platform for carrying said load and having a lengh-to-breadth ratio in the range between 1 2:1, 2:1, and said stabilizing means which comprise a single pair of discrete elongated floats separated from one another by said platform and oriented on said body of water so that either one of said floats provides the initial contact with wave motion contacting the buoyant structure, said floats being of a rectangular configuration and disposed parallel to one another and to opposite ends of said buoyant platform and having a breadth similar to that of said buoyant platform, and a pair of elongated rigid booms projecting between each of said floats and said buoyant platform for separating each float from said buoyant platform and for rigidly securing each float to said buoyant platform, said rigid booms forming projections with sides of said buoyant platform and separating each float from said buoyant platform a distance in a range corresponding to about one-eighth to about one-half of the length of said buoyant platform.

2. The buoyant structure claimed in claim 1, wherein said floats each have a length in the range of about 0.04 to about 0.31 of the length of the buoyant platform, and wherein the thickness of said float is in the range of 0.007 to about 0.07 of the length of said buoyant platform.

* * * * *